US005967136A

United States Patent [19]

Gray et al.

[11] Patent Number: 5,967,136

[45] Date of Patent: Oct. 19, 1999

[54] ISLAND COUNTERTOP STOVE HOOD

[76] Inventors: Jimmie L. Gray, 6838 SW. 127 Pl., Miami, Fla. 33183; Karl L. Magleby, 2666 Riviera Manor, Weston, Fla. 33332-3422

[21] Appl. No.: 09/137,314

[22] Filed: Aug. 20, 1998

[51] Int. Cl.[6] ..... F24C 3/12; F24C 15/20

[52] U.S. Cl. ..... 126/299 R; 126/299 C; 126/42

[58] Field of Search ..... 126/299 R, 42, 126/299 C, 299 D, 21 R, 22; 454/56

[56] References Cited

U.S. PATENT DOCUMENTS

| | | | |
|---|---|---|---|
| D. 303,909 | 10/1989 | Stankus et al. . | |
| D. 306,119 | 2/1990 | Stockman et al. . | |
| 957,642 | 5/1910 | Barker . | |
| 1,001,383 | 8/1911 | Geer et al. | 126/299 C |
| 2,563,078 | 8/1951 | Silberman . | |
| 2,582,373 | 1/1952 | Cordrey | 126/299 C |
| 2,836,171 | 5/1958 | Cripe | 126/299 C |
| 3,814,078 | 6/1974 | Etzcorn . | |
| 4,422,441 | 12/1983 | Schoepe . | |
| 5,078,122 | 1/1992 | Kalenian . | |
| 5,279,279 | 1/1994 | White . | |
| 5,333,599 | 8/1994 | Jang . | |
| 5,351,673 | 10/1994 | Somerton . | |
| 5,842,464 | 12/1998 | Koch | 126/299 R |

FOREIGN PATENT DOCUMENTS

| | | | |
|---|---|---|---|
| 513254 | 2/1955 | Italy | 126/299 C |
| 0076830 | 4/1986 | Japan | 126/299 C |

*Primary Examiner*—James C. Yeung
*Assistant Examiner*—Sara Clarke
*Attorney, Agent, or Firm*—John V. Stewart

[57] ABSTRACT

A ventilation hood (1, 2) for cooking stoves (20) comprising a generally U-shaped shell having an upper portion (2) and a lower portion (1), the upper portion being transparent, and the lower portion being highly heat resistant. The shell is open in the front, covered transparently at the top, and is tall enough to allow convenient access to the cook top (21). It transmits illumination to the cook top from available lighting above the hood. It catches fumes rising from the cook top, guides them to a conventional exhaust fan inlet (23) at the back of the cook top, and blocks any spatter projected from the cook top toward the sides, back, or upward.

9 Claims, 3 Drawing Sheets

8
9
11
10
6
4
6a
5
2
7
1
23
3
20

ISLAND COUNTERTOP STOVE HOOD

BACKGROUND OF THE INVENTION

1. Field of the Invention

This invention is in the field of ventilation hoods for island cooking stoves, especially portable hoods.

2. Description of Prior Art

Cooking stoves often have exhaust fans to remove cooking odors and heat. A common location for the exhaust fan inlet, especially on island stoves, is at the back of the cook top. The exhaust is channeled outside through ducts in the floor. However, due to the openness of the cooking area, fumes and heat are not efficiently collected. Instead, they escape into the room, adding odor and heat to the interior.

Several prior patents show portable hoods designed as spatter guards for stoves. Other hoods are shown for scavenging heat and exhaust fumes efficiently and directing them toward exhaust fans.

U.S. Pat. No. 3,814,078 (Etzcorn) shows a portable hood for stoves that have a protective cover hinged at the back, such as in motor homes. The hood comprises sides and a top which attach to the existing stove cover in its vertical position, and serves as a spatter guard. Various designs for portable folding spatter guards are shown in U.S. Pat. Nos. 2,563,078 (Silberman), 957,642 (Barker), and D303,909 (Stankus).

U.S. Pat. No. 5,279,279 (White) shows a deflector for cooking fumes, to increase scavenging efficiency of an exhaust fan inlet between the cooking elements. U.S. Pat. No. 5,078,122 (Kalenian) shows a removable hood for a counter top stove for channeling cooking fumes to an exhaust fan inlet located between the elements.

These prior devices are each useful in specific situations, but they do not provide all the benefits of the present invention as described below.

SUMMARY OF THE INVENTION

The objective of the present invention is a portable stove-top hood for island countertop stoves with a ventilation exhaust fan inlet at the back, whereby the hood directs cooking odors and heat efficiently to the exhaust fan inlet without obstructing the cooking area or blocking light from it.

These objectives are achieved by a ventilation hood (1, 2) for cooking stoves (20) comprising a generally U-shaped shell having an upper portion (2) and a lower portion (1), the upper portion being transparent, and the lower portion being highly heat resistant. The shell is open in the front, covered transparently at the top, and is tall enough to allow convenient access to the cook top (21). It transmits illumination to the cook top from available lighting above the stove. The hood catches and directs heat and odor rising from the cook top to a conventional exhaust fan inlet (23) at the back of the cook top, and blocks any spatter projected from the cook top toward the sides, back, or upward.

REFERENCE NUMERALS

Figure 1:
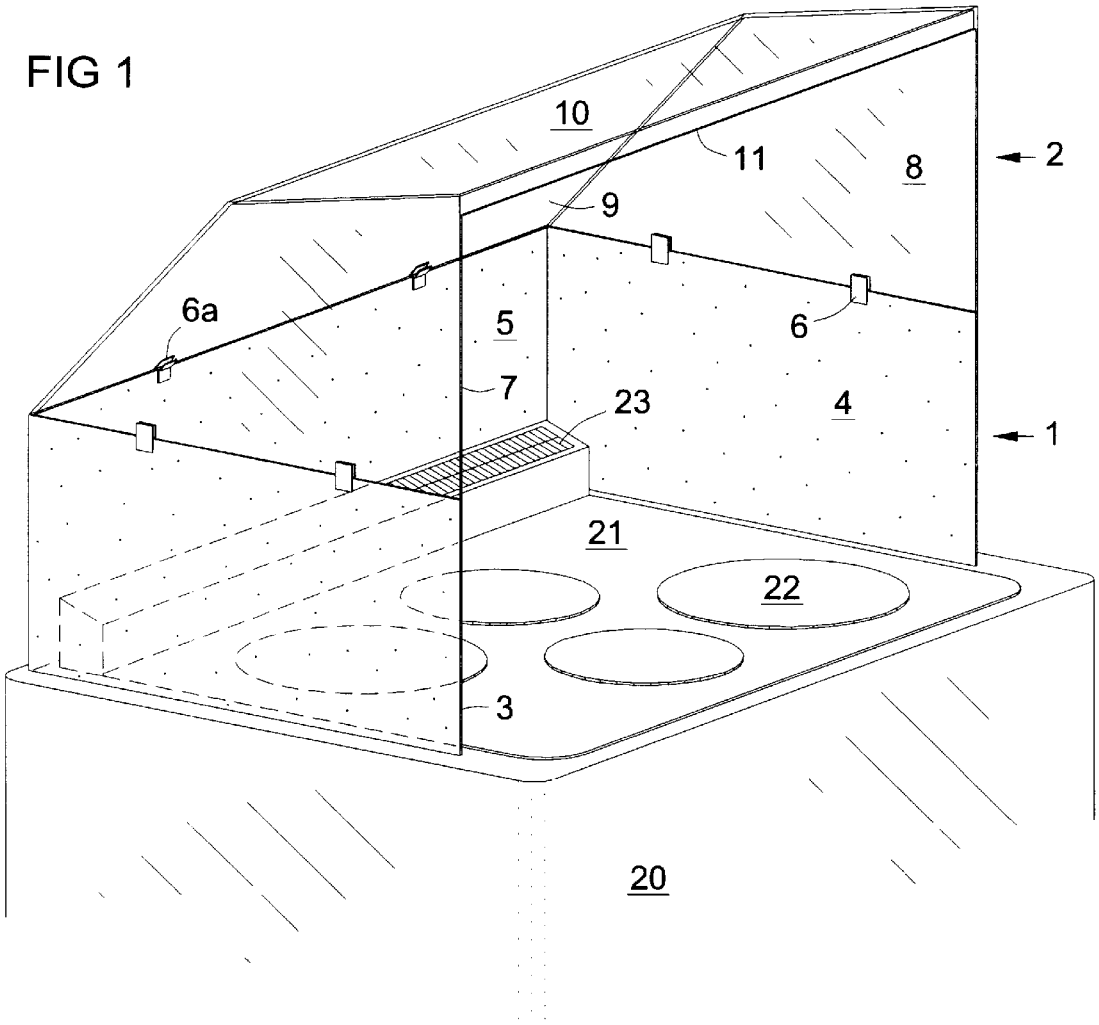
FIG. 1 is a perspective frontal view of the installed hood.
Figure 2:
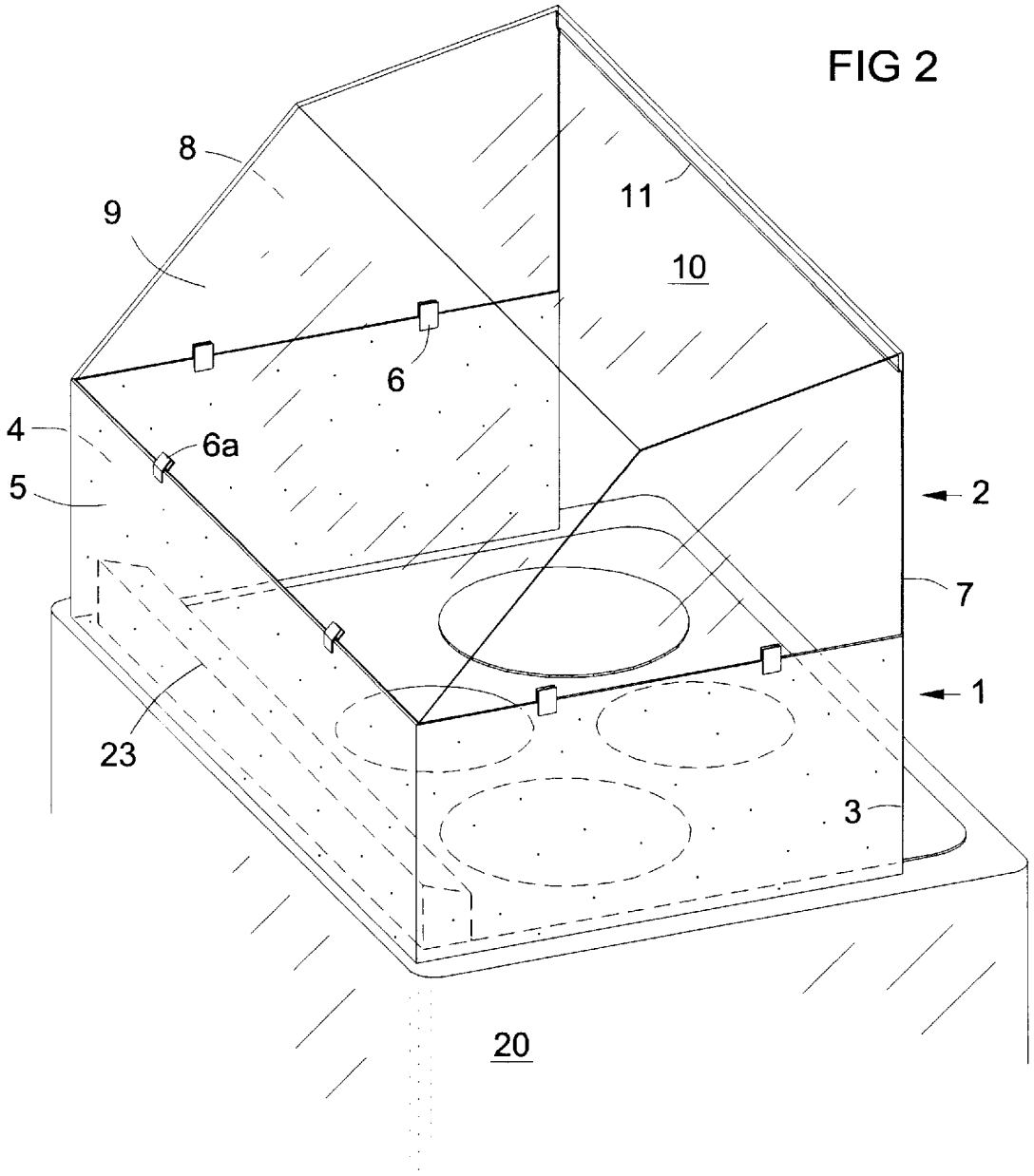
FIG. 2 is a perspective rear view of the installed hood.
Figure 3:
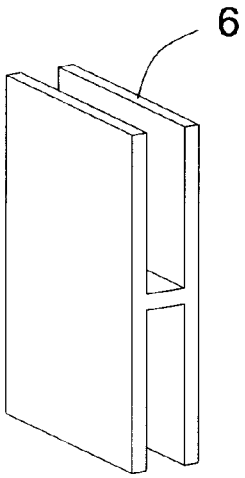
FIG. 3 is a perspective view of an H-fastener, suggested for easy assembly.
Figure 4:
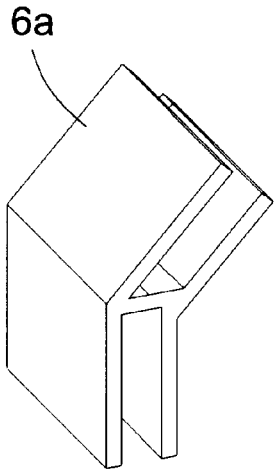
FIG. 4 is a perspective view of an angular H-fastener.

1. Lower wall
2. Upper shell

3. Lower left side
4. Lower right side
5. Lower back side
6. H-fastener for mounting the upper shell on the lower wall.
6*a*. Angular H-fastener.
7. Upper left side
8. Upper right side
9. Upper back side
10. Top
11. Reinforcement bar
20. Stove cabinet
21. Cook top
22. Cooking element or eye
23. Exhaust fan inlet

DESCRIPTION OF THE PREFERRED EMBODIMENTS

FIG. 1 shows the hood installed on an island stove (20) having a rear exhaust fan inlet (23). The hood comprises a shell with lower (1) and upper (2) portions, each designed to provide a specific benefit. The lower wall portion (1) is highly heat resistant, to withstand radiant, convective, and conductive heat which may be transferred to it by the closeness of a gas flame spreading under a cooking pan, by grease spatter, or by contact with a large cooking pan. The upper shell (2) is transparent, to provide illumination to the cook top by allowing light to enter the hood from above.

The upper shell (2) is preferably made of heat resistant rigid plastic. The lower wall (1) of the hood should have additional heat resistance. It can be made of a different material from the upper shell, such as metal, and the two parts fastened together as shown. Alternately, the hood can be all one material, such as heat resistant transparent plastic, with a layer of highly heat resistant material such as ceramic or metal, applied to the inner surface of the lower portion.

The hood is simply placed over the cook top (21) by the user, and can be easily removed therefrom for cleaning. If the hood is made in two parts as shown, the lower wall (1) is first placed over the cook top, then H-fasteners are placed on the top edge of the lower wall, then the upper shell (2) is placed on the lower wall within the H-fasteners. Preferably, a shallow rectangular depression is provided for each H-fastener in the both the upper edge of the lower wall and in the lower edge of the upper shell. Each depression should be half as deep as the thickness of the crossbar of an H-fastener. This accurately aligns and stabilizes the upper and lower portions of the shell, and avoids a gap between them. Alternately, a rectangular depression, which is as deep as the thickness of the crossbar of an H-fastener, can be provided in only the upper edge of the lower wall or the lower edge of the upper wall.

The panels can be hinged to fold flat against each other compactly for shipping and storage. The shape of the hood may vary as a design preference. For example, the back (9) and top (10) of the upper shell may be formed as a continuous curve, rather than two flat panels as shown.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

We claim:

1. A hood for stoves comprising:

a shell having left, right, and back sides, a covered top, and an open front;

the shell having upper and lower portions, the upper portion, including the covered top, being transparent to visible light, and the lower portion being more heat resistant than the upper portion.

2. The hood of claim 1 wherein the shell is made of transparent, heat resistant plastic, and the lower portion thereof has an inner surface coated with a layer of material that is more heat resistant than said heat resistant plastic.

3. The hood of claim 1 wherein the upper portion of the shell is made of transparent, heat resistant plastic, and the lower portion of the shell is made of metal, the upper portion mounted atop, and fastened to, the lower portion.

4. A hood for placement on a stove cooktop, comprising:

a heat resistant vertical lower wall having left, back, and right panels;

an upper transparent shell fastened to, and extending upward from, the lower wall, and having a transparent top cover;

the lower wall and the upper shell forming a hood with an open front;

whereby the lower wall is resistant to heat damage, and the upper shell admits light.

5. The hood of claim 4, wherein the lower wall is made of metal, and the upper shell is made of plastic.

6. The hood of claim 4, wherein the lower wall and upper shell are both made of plastic, and the lower wall has an inner surface with a heat resistant layer.

7. An improved stove cooktop having a horizontal surface with front, back, left, and right sides, a plurality of heating elements arranged on the horizontal surface, and an exhaust fan at the back side of the horizontal surface, the improvement residing in a hood comprising:

a heat resistant vertical lower wall surrounding the cooktop on the left, right, and back sides;

an upper transparent shell fastened to, and extending upward from, the lower wall, having a transparent top cover;

the lower wall and the upper shell forming a hood over the cooktop and the exhaust fan, with an open front;

whereby the hood channels cooking odors and fumes to the exhaust fan, the lower wall is resistant to heat damage from the heating elements, and the upper shell admits light for illumination and viewing of the cooktop.

8. The improved cooktop of claim 7, wherein the lower wall of the hood is made of metal, and the upper shell of the hood is made of plastic.

9. The improved cooktop of claim 7, wherein the lower wall upper shell of the hood are both made of plastic, and the lower wall has an inner surface with a heat resistant layer.

* * * * *